US009045327B2

(12) United States Patent
Gormley et al.

(10) Patent No.: US 9,045,327 B2
(45) Date of Patent: Jun. 2, 2015

(54) LIQUID DISPENSING LED NOZZLE

(71) Applicant: General Electric Company, Schenectady, NY (US)

(72) Inventors: Joseph Emil Gormley, Louisville, KY (US); Ronald Scott Tarr, Louisville, KY (US)

(73) Assignee: General Electric Company, Schenectady, NY (US)

( * ) Notice: Subject to any disclaimer, the term of this patent is extended or adjusted under 35 U.S.C. 154(b) by 120 days.

(21) Appl. No.: 13/856,000

(22) Filed: Apr. 3, 2013

(65) Prior Publication Data

US 2014/0299628 A1 Oct. 9, 2014

(51) Int. Cl.
*B67D 1/08* (2006.01)
*F21V 33/00* (2006.01)

(52) U.S. Cl.
CPC ..... *B67D 1/0872* (2013.01); *F21V 33/0044* (2013.01); *B67D 1/0875* (2013.01)

(58) Field of Classification Search
CPC ..... F21V 33/0044; B67D 1/0875
USPC ..... 222/113, 129.1; 62/389; 362/96, 806, 362/101, 253, 800; 239/18
See application file for complete search history.

(56) References Cited

U.S. PATENT DOCUMENTS

| | | | | | |
|---|---|---|---|---|---|
| 1,466,677 | A | * | 9/1923 | Sundh | 222/113 |
| 1,848,179 | A | * | 3/1932 | Kiester | 362/96 |
| 2,034,420 | A | * | 3/1936 | Relland et al. | 137/202 |
| 2,330,592 | A | * | 9/1943 | Kendrick | 362/562 |
| 2,598,357 | A | * | 5/1952 | Coleman | 222/113 |
| 3,184,587 | A | * | 5/1965 | Quijada | 362/96 |
| 3,866,832 | A | * | 2/1975 | Noguchi | 239/18 |
| 4,239,129 | A | * | 12/1980 | Esposito | 222/79 |
| 4,749,126 | A | * | 6/1988 | Kessener et al. | 239/12 |
| 4,901,922 | A | * | 2/1990 | Kessener et al. | 239/12 |
| 5,491,617 | A | * | 2/1996 | Currie | 362/96 |
| 5,558,653 | A | * | 9/1996 | Lindstrom | 604/295 |
| 6,021,960 | A | * | 2/2000 | Kehat | 239/289 |
| 6,126,290 | A | * | 10/2000 | Veigel | 362/96 |
| 6,804,974 | B1 | * | 10/2004 | Voglewede et al. | 62/264 |
| 7,008,073 | B2 | * | 3/2006 | Stuhlmacher, II | 362/96 |
| 7,404,649 | B2 | | 7/2008 | Gosis et al. | |
| 8,511,349 | B2 | * | 8/2013 | Kolber et al. | 141/11 |
| 2002/0020712 | A1 | * | 2/2002 | Hornsby et al. | 222/79 |
| 2003/0102825 | A1 | * | 6/2003 | Vinocur et al. | 315/362 |
| 2004/0032749 | A1 | * | 2/2004 | Schindler et al. | 362/555 |
| 2005/0056663 | A1 | * | 3/2005 | Yu | 222/113 |
| 2005/0276035 | A1 | * | 12/2005 | Currie | 362/96 |
| 2006/0255168 | A1 | * | 11/2006 | Huang et al. | 239/18 |
| 2008/0163641 | A1 | * | 7/2008 | Mitchell | 62/389 |
| 2009/0057341 | A1 | * | 3/2009 | Girard et al. | 222/129.1 |
| 2012/0103000 | A1 | | 5/2012 | Krause et al. | |
| 2013/0068791 | A1 | * | 3/2013 | Pelfrey et al. | 222/113 |
| 2014/0252035 | A1 | * | 9/2014 | Chia | 222/113 |

FOREIGN PATENT DOCUMENTS

DE 202006013708 U1 12/2006

* cited by examiner

*Primary Examiner* — Donnell Long
(74) *Attorney, Agent, or Firm* — Dority & Manning, P.A.

(57) ABSTRACT

A dispenser is provided having a nozzle that can direct light down a stream of liquid exiting therefrom. The nozzle includes one or more features to promote a substantially laminar flow of liquid therethrough. This construction can allow the light to travel farther down the stream of liquid exiting the nozzle than in e.g., non-laminar flow. Such light transmission can allow the user to more accurately view the dispenser and liquid flow when filling a container with liquid.

18 Claims, 8 Drawing Sheets

LIQUID DISPENSING LED NOZZLE

FIELD OF THE INVENTION

The subject matter of the present disclosure relates generally to a dispenser for an appliance that has a liquid dispensing nozzle.

BACKGROUND OF THE INVENTION

Refrigerator appliances generally include a cabinet that defines a chilled chamber for receipt of food items for storage. Refrigerator appliances can also include features for dispensing ice and/or water. To dispense ice and/or water, certain refrigerator appliances include a dispensing assembly mounted to a door of the appliance. The dispenser assembly can have a dispenser recess defined by the door. The dispensing assembly can also direct water from a water supply to a water dispensing outlet within the dispenser recess.

As an example, a user can insert a container into the dispenser recess and initiate a flow of water into the container. In particular, certain refrigerator appliances include a paddle mounted within the dispenser recess. The user can push the container against the paddle in order to initiate the flow of water into the container. Other refrigerator appliances may instead include a button on a user interface which initiates the flow of water into the container.

However, filling certain containers with water from the dispensing assembly can be troublesome. For example, certain water bottles have relatively small openings. Directing a flow of water from the water dispensing outlet into the bottle's relatively small opening can be difficult because it is often difficult to see e.g., the source of the water within the dispenser recess or the flow of water in the dispenser recess—particularly given that water is translucent.

As such, some refrigerator appliances may include one or more light sources positioned proximate to the flow of water in an attempt to illuminate the dispenser recess and/or the flow of water. However, even with these configurations, it can still be difficult for a user to see the flow of water.

Accordingly, a liquid dispenser with one or more features whereby the user can more accurately locate a container in the dispenser and observe the flow of a liquid into the container would be beneficial.

BRIEF DESCRIPTION OF THE INVENTION

The present disclosure provides a dispenser having a nozzle that can direct light down a stream of liquid exiting therefrom. The nozzle includes one or more features to promote a substantially laminar flow of liquid therethrough. This construction can allow the light to travel farther down the stream of liquid exiting the nozzle than in e.g., non-laminar flow. Such light transmission can allow the user to more accurately view the dispenser and liquid flow when filling a container with liquid. Additional aspects and advantages of the present disclosure will be set forth in part in the following description, or may be apparent from the description, or may be learned through practice of the disclosure.

In one exemplary embodiment of the present disclosure, a dispenser is provided for dispensing a liquid. The dispenser includes a liquid supply and a nozzle in fluid communication with the liquid supply. The nozzle defines an axial direction and a radial direction that are orthogonal to each other. Additionally, the nozzle includes a first end along the axial direction and a second end downstream and opposite to the first end along the axial direction. The nozzle also includes a light source having at least a portion positioned between the first end and the second end, and an annular liquid flow channel extending longitudinally along the axial direction between the first end to the second end and around the light source, the flow channel configured to promote a substantially laminar flow of liquid. The nozzle also includes a cone positioned upstream of the light source and in the flow channel, the cone having a tip directed towards the first end.

In another exemplary embodiment of the present disclosure, a dispensing assembly is provided for use in a refrigerator appliance. The dispensing assembly includes a dispenser recess and a dispenser. The dispenser includes a liquid supply positioned proximate to the dispenser recess and a nozzle in fluid communication with the liquid supply and configured to promote a substantially laminar flow of a liquid from the liquid supply to the dispenser recess. The nozzle includes a first end configured to receive a liquid from the liquid supply, a second end configured to dispense the liquid, and a circumferential wall extending from the first end to the second end. The nozzle additionally includes a light source having at least a portion positioned within the circumferential wall, and a cone positioned upstream of the light source within the circumferential wall, the cone and the circumferential wall together defining an annulus for the flow through of the liquid from the first end towards the second end.

These and other features, aspects and advantages of the present disclosure will become better understood with reference to the following description and appended claims. The accompanying drawings, which are incorporated in and constitute a part of this specification, illustrate embodiments of the disclosure and, together with the description, serve to explain the principles of the disclosure.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
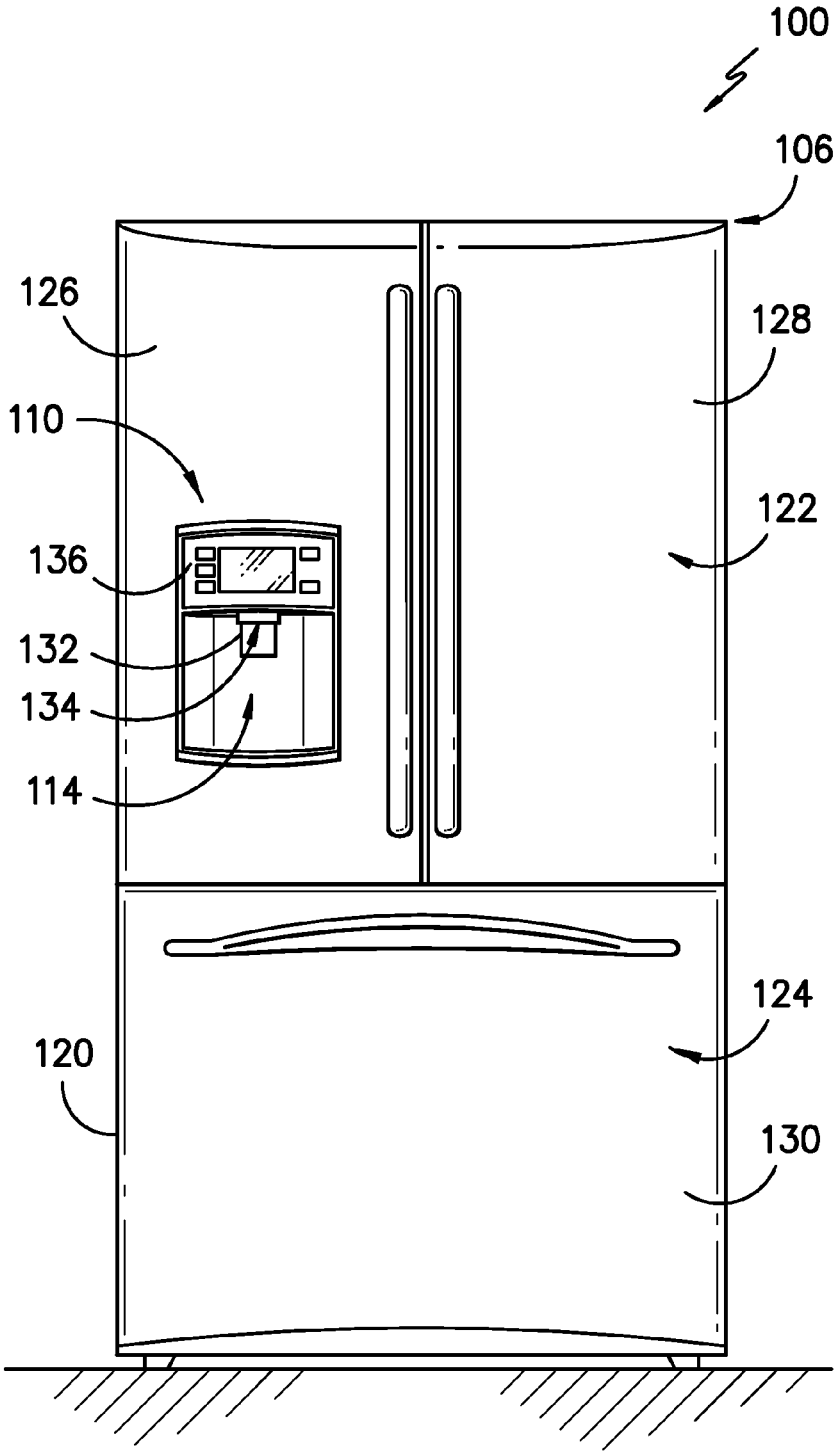
FIG. 1 provides a front view of a refrigerator appliance according to an exemplary embodiment of the present disclosure.

Reference now will be made in detail to embodiments of the disclosure, one or more examples of which are illustrated in the drawings. Each example is provided by way of explanation of the disclosure, not limitation of the disclosure. In fact, it will be apparent to those skilled in the art that various modifications and variations can be made in the present disclosure without departing from the scope or spirit of the disclosure. For instance, features illustrated or described as part of one embodiment can be used with another embodiment to yield a still further embodiment. Thus, it is intended that the present disclosure covers such modifications and variations as come within the scope of the appended claims and their equivalents.

FIG. 1 provides a front view of an exemplary embodiment of a refrigerator appliance 100. Refrigerator appliance 100 includes a cabinet or housing 120 defining an upper fresh food chamber 122 and a lower freezer chamber 124 arranged below the fresh food chamber 122. As such, refrigerator appliance 100 is generally referred to as a bottom mount refrigerator. In the exemplary embodiment, housing 120 also defines a mechanical compartment (not shown) for receipt of a sealed cooling system. Using the teachings disclosed herein, however, one of skill in the art will understand that the present disclosure can be used with other types of refrigerators as well (e.g., side-by-side refrigerators). Consequently, the description set forth herein of exemplary refrigerator appliance 100 is for illustrative purposes only and is not intended to limit the disclosure in any aspect.

Refrigerator doors 126, 128 are rotatably hinged to an edge of housing 120 for accessing fresh food compartment 122. A freezer door 130 is arranged below refrigerator doors 126, 128 for accessing freezer chamber 124 and is coupled to a freezer drawer (not shown) slidably mounted within freezer chamber 124.

Refrigerator appliance 100 further includes a dispensing assembly 110 for dispensing water and/or ice. Dispensing assembly 110 includes a dispenser recess 114 positioned on an exterior portion of refrigerator appliance 100. Dispenser recess 114 is defined in an outside surface of refrigerator door 126 and is positioned at a predetermined elevation convenient for a user to access ice and/or water. This enables the user to access ice without the need to bend-over and without the need to access freezer chamber 124. In this exemplary embodiment, dispenser recess 114 is positioned at a level that approximates the chest level of a user.

Dispenser recess 114 further includes a discharging outlet 134 for accessing ice and/or water and an activation member 132 mounted below discharging outlet 134 for operating dispenser assembly 110. In FIG. 1, activation member 132 is shown as a paddle. However, activation member 132 may be any other suitable mechanism for signaling or initiating a flow of ice and/or water into a container positioned within dispenser recess 114, e.g., a switch or button.

A user interface panel 136 is provided for controlling the mode of operation of dispensing assembly 110. For example, user interface panel 136 includes a water dispensing button (not labeled) and an ice-dispensing button (not labeled) for selecting a desired mode of operation such as crushed or non-crushed ice.

Operation of the refrigerator appliance 100 is regulated by a controller (not shown) that is operatively coupled to the user interface panel 136 and/or activation member 132. Panel 136 provides selections for user manipulation of the operation of refrigerator appliance 100 such as e.g., selections between whole or crushed ice, chilled water, and/or other options as well. In response to user manipulation of the user interface panel 136, the controller operates various components of the refrigerator appliance 100. The controller may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor.

The controller may be positioned in a variety of locations throughout refrigerator appliance 100. The controller can be located within or beneath the user interface panel 136 on door 126. In such an embodiment, input/output ("I/O") signals may be routed between the controller and various operational components of refrigerator appliance 100. In one exemplary embodiment, the user interface panel 136 may represent a general purpose I/O ("GPIO") device or functional block. In another exemplary embodiment, the user interface 136 may include input components, such as one or more of a variety of electrical, mechanical or electro-mechanical input devices including rotary dials, push buttons, and touch pads. The user interface 136 may be in communication with the controller via one or more signal lines or shared communication busses.

Figure 2:
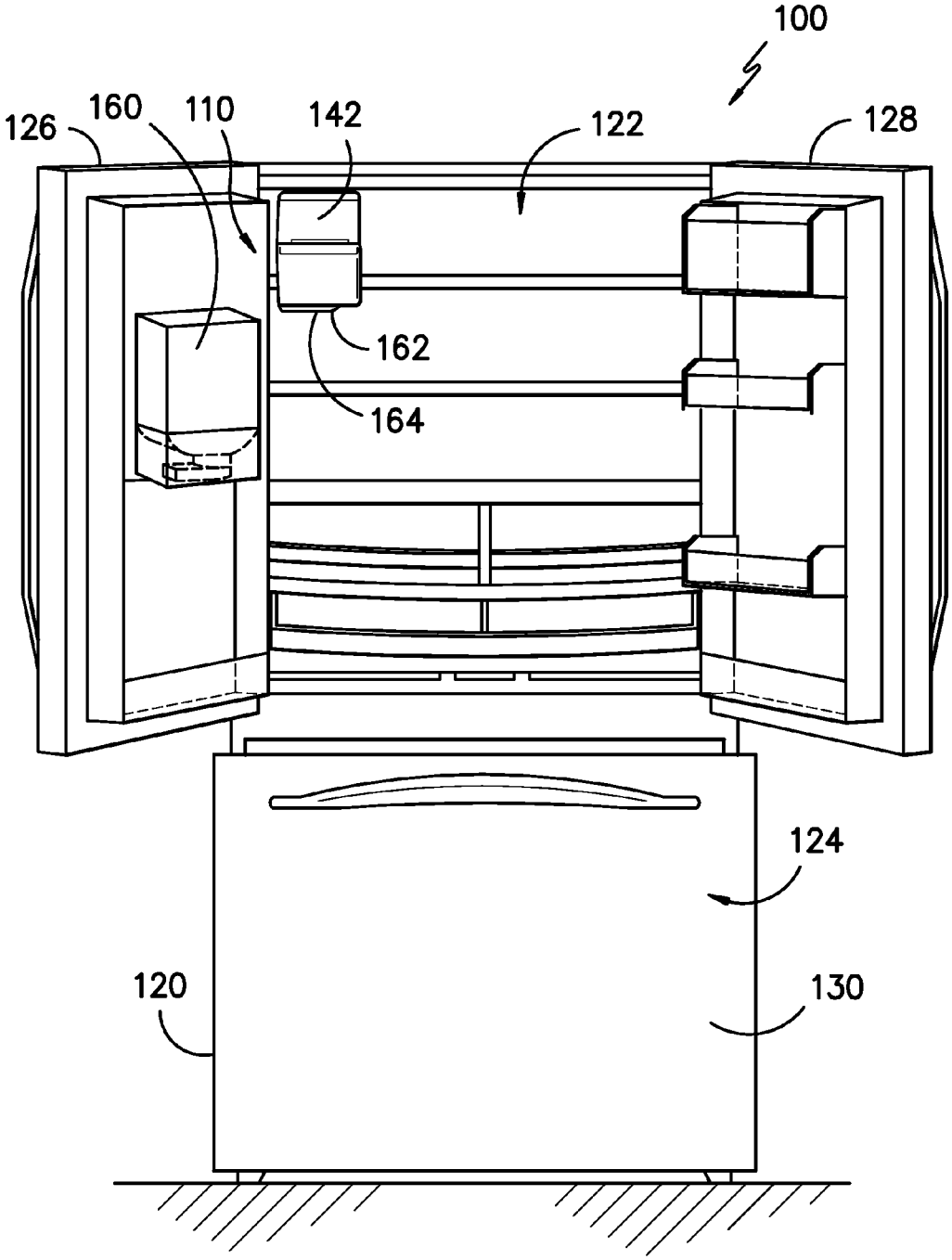
FIG. 2 provides a front view of the refrigerator appliance of FIG. 1 with refrigerator doors of the refrigerator appliance shown in an open configuration to reveal a fresh food chamber of the refrigerator appliance.

FIG. 2 provides a front view of refrigerator appliance 100 having refrigerator doors 126, 128 in an open position to reveal the interior of the fresh food chamber 122. As such, certain components of dispensing assembly 110 are illustrated. Dispensing assembly 110 further includes an insulated housing 142 mounted within refrigerator chamber 122. Due to insulation surrounding insulated housing 142, the temperature within insulated housing 142 can be maintained at levels different from the ambient temperature in the surrounding fresh food chamber 122.

In particular, insulated cavity 142 is constructed and arranged to operate at a temperature that facilitates producing and storing ice. More particularly, the insulated cavity contains an ice maker for creating ice and feeding the same to a receptacle 160 that is mounted on refrigerator door 126. As illustrated in FIG. 2, receptacle 160 is placed at a vertical position on refrigerator door 126 that will allow for the receipt of ice from a discharge opening 162 located along a bottom edge 164 of insulated housing 142 when refrigerator door 126 is in a closed position (shown in FIG. 1). As door 126 is closed or opened, receptacle 160 is moved into and out of position under insulated housing 142.

Alternatively, in another exemplary embodiment of the present invention, insulated housing 142 and its ice maker can be positioned directly on door 126. In still another exemplary embodiment of the present invention, in a configuration where the fresh food compartment and the freezer compartment are located side by side (as opposed to over and under as shown in FIGS. 1 and 2), the ice maker could be located on the door for the freezer compartment and directly over receptacle 160. As such, the use of an insulated housing would be unnecessary. Other configurations for the location of receptacle 160, an ice maker, and/or insulated housing 142 may be used as well.

Figure 3:
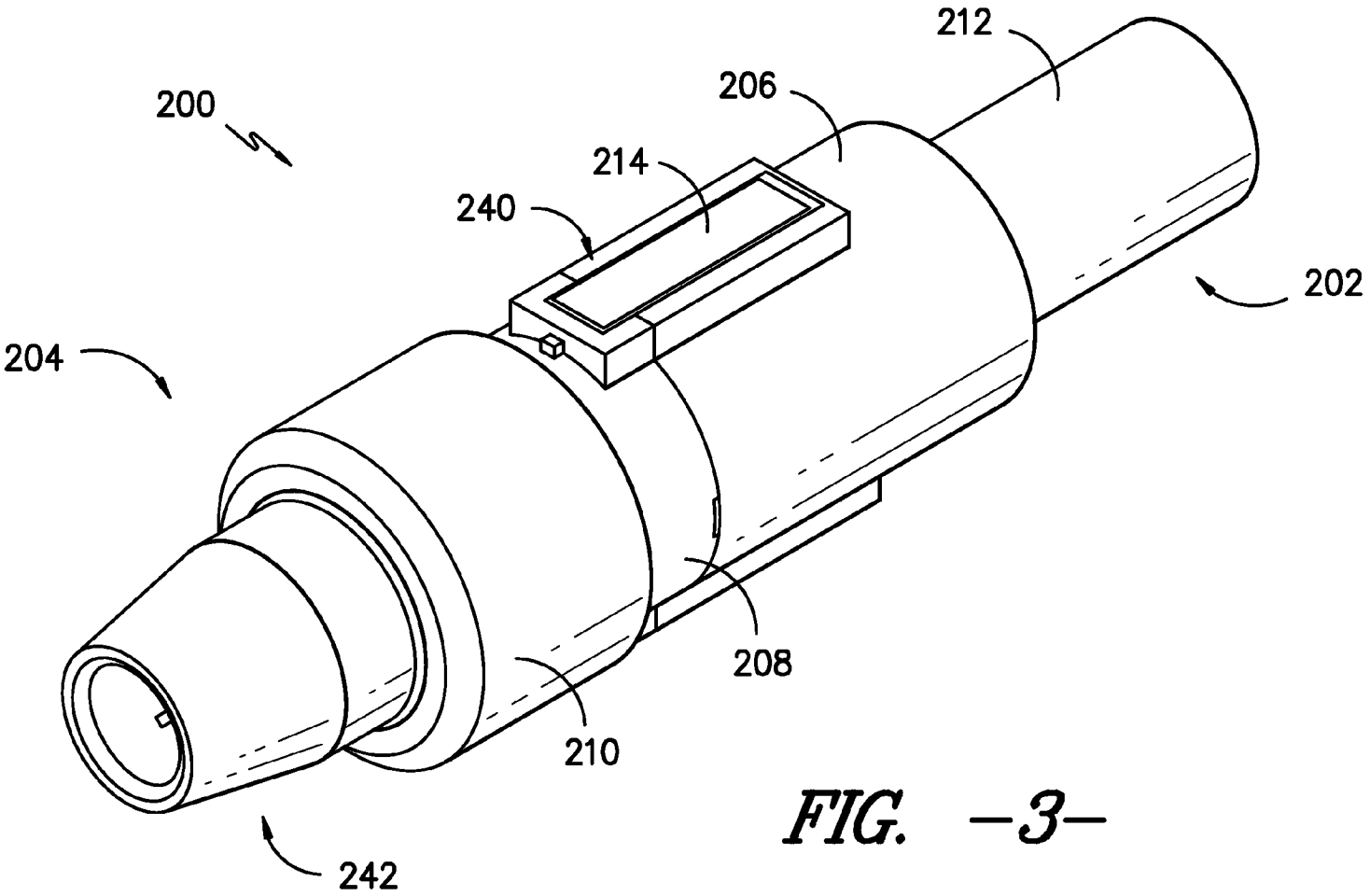
FIG. 3 provides an assembled perspective view of an exemplary embodiment of a nozzle according to the present disclosure.
Figure 4:
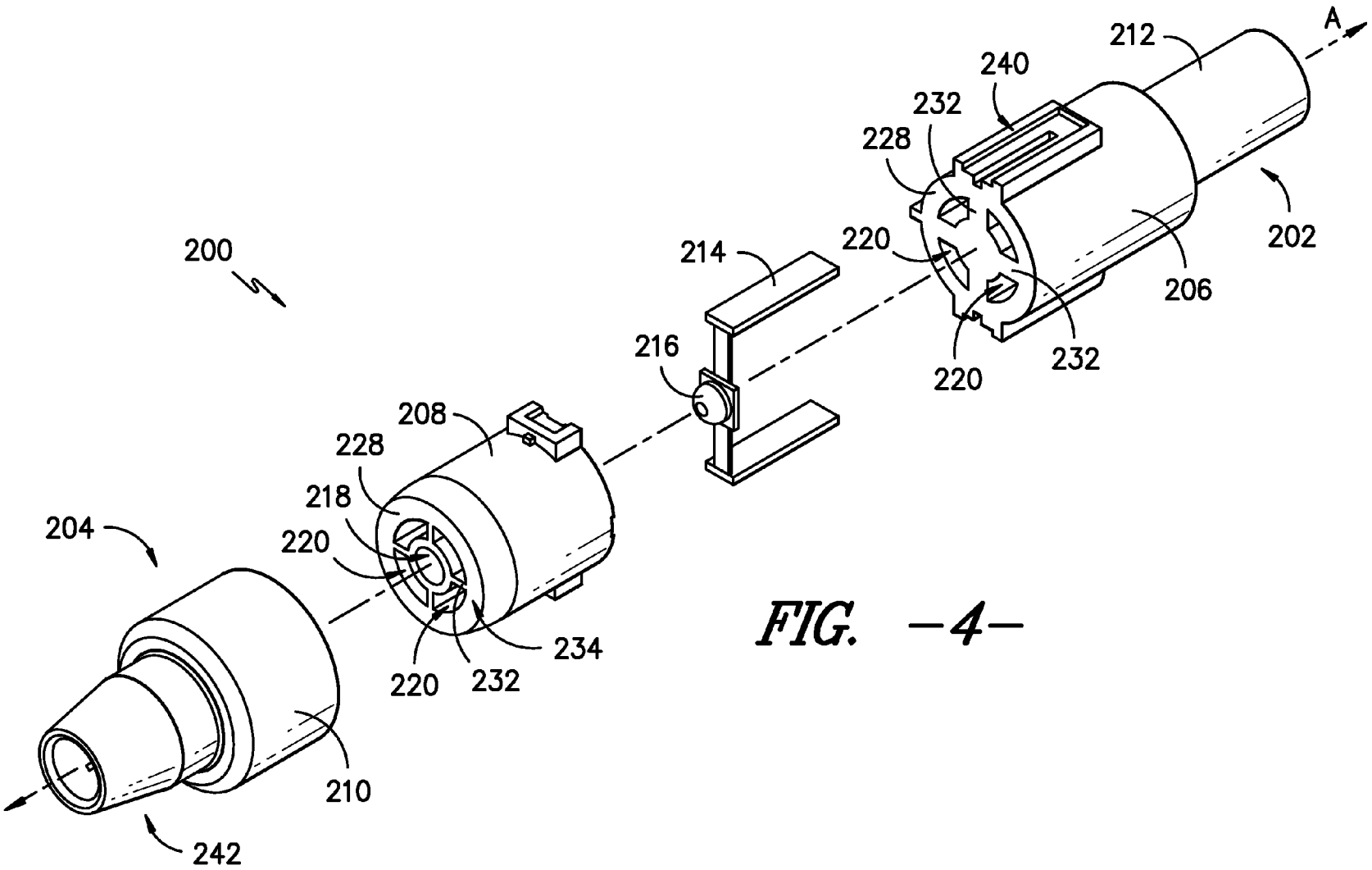
FIG. 4 provides an exploded perspective view of the exemplary nozzle of FIG. 3.
Figure 5:
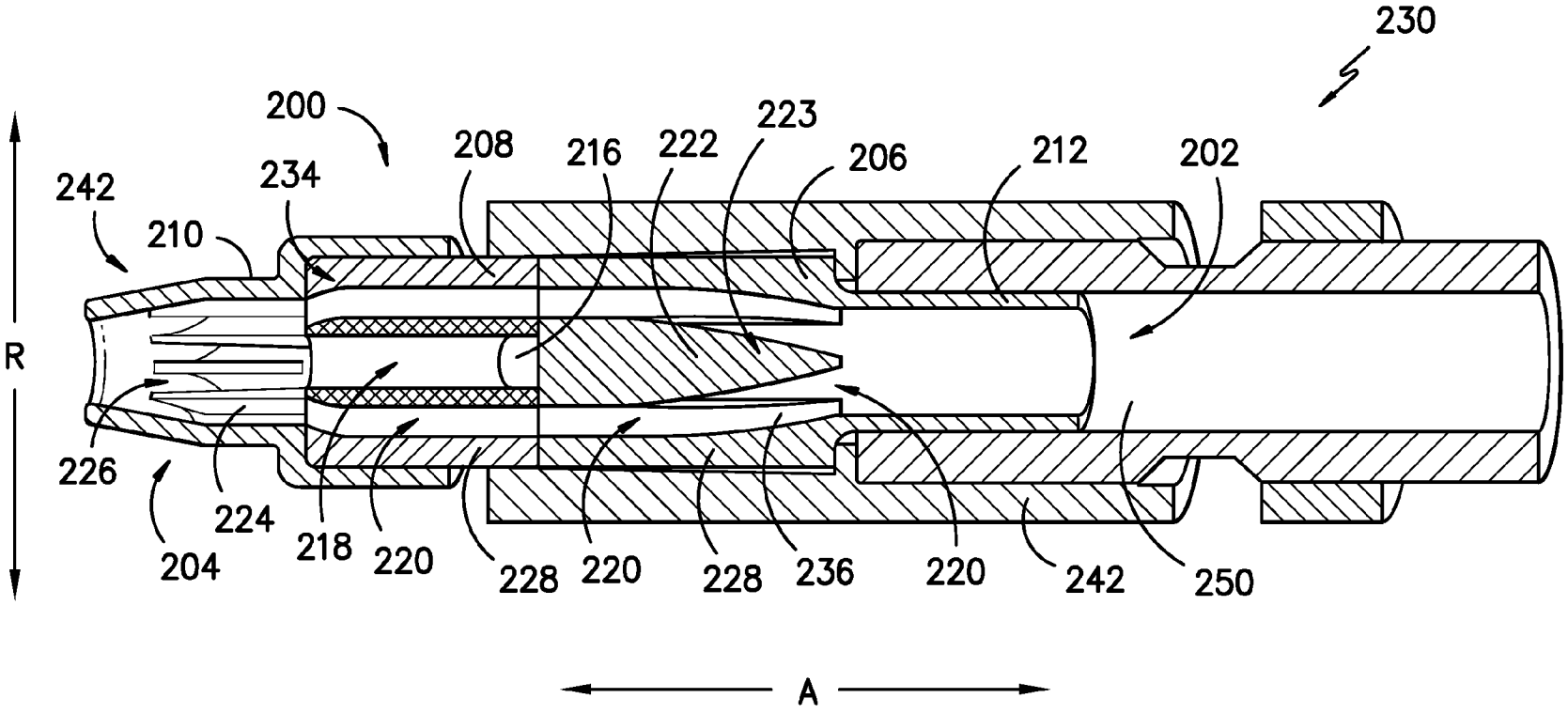
FIG. 5 provides a cross-sectional side view of the exemplary nozzle of FIG. 3 attached to a liquid supply and positioned in a dispenser cavity.

Referring now FIGS. 3, 4, and 5, an exemplary embodiment of a nozzle 200 of the present disclosure is illustrated. Specifically, FIG. 3 provides an assembled perspective view of an exemplary nozzle 200, FIG. 4 provides an exploded perspective view of the exemplary nozzle 200 of FIG. 3, and FIG. 5 provides a cross sectional side view of the exemplary nozzle 200 of FIG. 3 positioned in an exemplary dispenser 230.

As shown, nozzle 200 defines an axial direction A and a radial direction R that is orthogonal to the axial direction A.

At one end of nozzle 200 along axial direction A is a second end 204 that is downstream from, and opposite to, a first end 202 along the axial direction A. First end 202 is configured to receive a liquid from liquid supply 250, and second end 204 is configured to dispense the liquid. Such an exemplary embodiment of dispenser 230 can be connected with a liquid supply 250 positioned proximate to dispenser recess 114 of exemplary refrigerator 100, such that liquid can flow from liquid supply 250 through nozzle 200 at dispenser recess 114.

Referring specifically to FIGS. 3 and 4, nozzle 200 includes a first component 206 and a separate second component 208. First and second components 206, 208 together define a circumferential wall extending from first end 202 to second end 204, which for this exemplary embodiment is a cylindrically-shaped wall 228. Additionally, nozzle 200 includes a light source 216 configured to direct light in a downstream direction such that light can travel down a stream of liquid exiting from second end 204 of nozzle 200. At least a portion of light source 216 is positioned within cylindrically-shaped wall 228 between first end 202 and second end 204 of nozzle 200. More particularly, at least a portion of light source 216 is positioned within a cylindrical channel 218 extending along the axial direction A through second component 208. As shown, cylindrical channel 218 and light source 216 are positioned approximately in the center of nozzle 200 along the radial direction R. For this exemplary embodiment, light source 216 is a light emitting diode (LED).

It should be appreciated, however, that in other exemplary embodiments of the present disclosure, any other suitable light source can be used. By way of example, in other embodiments, light source 216 can be an incandescent light source or a fluorescent light source. Additionally, in other exemplary embodiments, a translucent or transparent lens or cap can be provided in cylindrical channel 218 to e.g., protect light source 216 from liquid flowing through flow channel 220.

Light source 216 is in electrical communication with a plurality of electrical contacts 214 positioned on an outer surface 240 of nozzle 200. Electrical contacts 214 are configured to provide light source 216 with electrical power. For this exemplary embodiment, nozzle 200 includes a pair of electrical contacts 214 extending longitudinally along axial direction A and configured to contact correspondingly positioned terminals (not shown) inside dispenser casing 242 (FIG. 5).

Light source 216 can be positioned in cylindrical channel 218 prior to joining the first component 206 and the second component 208. Once light source 216 is in position, first and second components 206, 208 can be joined together by any suitable means. For example, first and second components 206, 208 can be glued together, welded together using e.g., ultrasonic welding, etc.

Additionally, operation of light source 216 can be controlled in any suitable manner. By way of example, in one exemplary embodiment, the controller in exemplary refrigerator appliance 100 (FIGS. 1 and 2) can be operatively coupled to light source 216. In such an embodiment, the controller can be configured to illuminate light source 216 whenever e.g., liquid flows through nozzle 200. Alternatively, light source 216 can be configured to operate whenever activation member 132 of exemplary refrigerator appliance 100 initiates a flow of water.

Referring now specifically to FIGS. 4 and 5, nozzle 200 includes an attachment portion 212 positioned at first end 202, configured to attach nozzle 200 to liquid supply 250 within dispenser casing 242. In such a configuration, nozzle 200 is in fluid communication with liquid supply 250. Attachment portion 212 defines a seal between nozzle 200 and liquid supply 250 for connection with liquid supply 250. For this exemplary embodiment, attachment portion 212 is a compression fit attachment and is configured to allow nozzle 200 to be releasably connected to liquid supply 250. By being releasably connected to liquid supply 250, nozzle 200 can be removed by a user from dispenser casing 242 and liquid supply 250. Such a configuration allows nozzle 200 to be e.g., more easily and individually replaced, repaired, and/or cleaned or sterilized.

Nozzle 200 additionally includes an annular liquid flow channel 220 that extends longitudinally along the axial direction A between first end 202 and second end 204, and around light source 216. Although it is not necessarily possible to create a perfectly laminar flow of liquid through nozzle 200, flow channel 220 is configured to promote a substantially laminar flow of liquid. In other words, flow channel 220 is configured to minimize the amount of turbulence in the liquid as it flows through flow channel 220.

To assist in the promotion of a laminar flow of liquid through flow channel 220, a cone 222 is positioned in flow channel 220 upstream of light source 216. Cone 222 includes a tip 223 directed towards the first end 202 of nozzle 200 and against the direction of liquid flow. More particularly, cone 222 has a longitudinal axis that is substantially parallel to the axial direction A. Cone 222 and cylindrically-shaped wall 228 together define an annulus along the radial direction R for the flow-through of liquid from first end 202 to second end 204. An annulus is also defined in second component 208 by cylindrical channel 218 and wall 228 along radial direction R. Such a configuration can further promote the laminar flow of liquid through nozzle 200.

Additionally, a portion of flow channel 220 in second component 208 makes up a straight section 221 defining a length L along axial direction A. It has been determined that it can be desirable to optimize the length L of straight section 221, such that the liquid flowing therethrough achieves a minimum Reynolds number $R_{MIN}$. One having ordinary skill in the art will recognize that a laminar flow of liquid generally occurs when the Reynolds number associated with the flow of liquid is relatively low. For the particular geometry of straight section 221, the theoretical Reynolds number can be calculated using the following formula:

$$Re - \frac{V_{AVG} \times D_h}{v}.$$

In the above equation, "Re" corresponds to the Reynolds number of the liquid traveling through straight section 221, "$V_{AVG}$" corresponds to the average velocity of liquid traveling through straight section 221, "$D_h$" corresponds to the hydraulic diameter of straight section 221, and "v" corresponds to the kinematic viscosity for the liquid traveling through straight section 221. In one exemplary embodiment, $V_{AVG}$ can be approximately 0.774 m/s, v can be 0.000000658 $m^2/s$ (i.e., for water), and $D_h$ can be 0.0006 m (calculated based on a cross-sectional area and boundary perimeter for a particular exemplary embodiment). In such an exemplary embodiment, the theoretical Reynolds number can therefore be approximately 705.

The length L of straight section 221 required to achieve the theoretical Reynolds number can then be calculated using an entry length formula based on the Reynolds number (Re) and hydraulic diameter ($D_h$), as follows:

$$L \cong 0.05 \times Re \times D_h.$$

For the above exemplary embodiment, length L of straight section 221 can be at least approximately 0.0211 m in order to achieve the theoretical Reynolds number of approximately 705. The length L required for straight section 221 such that the flow of liquid has a Reynolds number of at least approximately $R_{MIN}$ can then be interpolated using the above information. More specifically, one having ordinary skill in the art will recognize that it can be assumed the Reynolds number is approximately 4,000 upstream of straight section 221 (i.e., at 0.00 m) and that it drops linearly through straight section 221 until it reaches the theoretical Reynolds number. Using the above assumptions, one having ordinary skill in the art can interpolate the required length L for the minimum Reynolds number $R_{MIN}$ desired.

By way of example, in one exemplary embodiment $R_{MIN}$ can be in the range of about 2500 to about 700. Alternatively, $R_{MIN}$ can be in the range of about 800 to about 2400. In still another exemplary embodiment, $R_{MIN}$ can be about 2300. One having ordinary skill in the art will recognize that for the liquid traveling through straight section 221 to achieve $R_{MIN}$, the length L of straight section 221 can be in the range of at least about 0.01 m to at least about 0.02 m. It should be appreciated, however, that the range provided for length L of straight section 221 is an approximation, and in other exemplary embodiments, straight section 221 can be longer or shorter than at least 0.01 meters or at least 0.02 meters.

Figure 6:
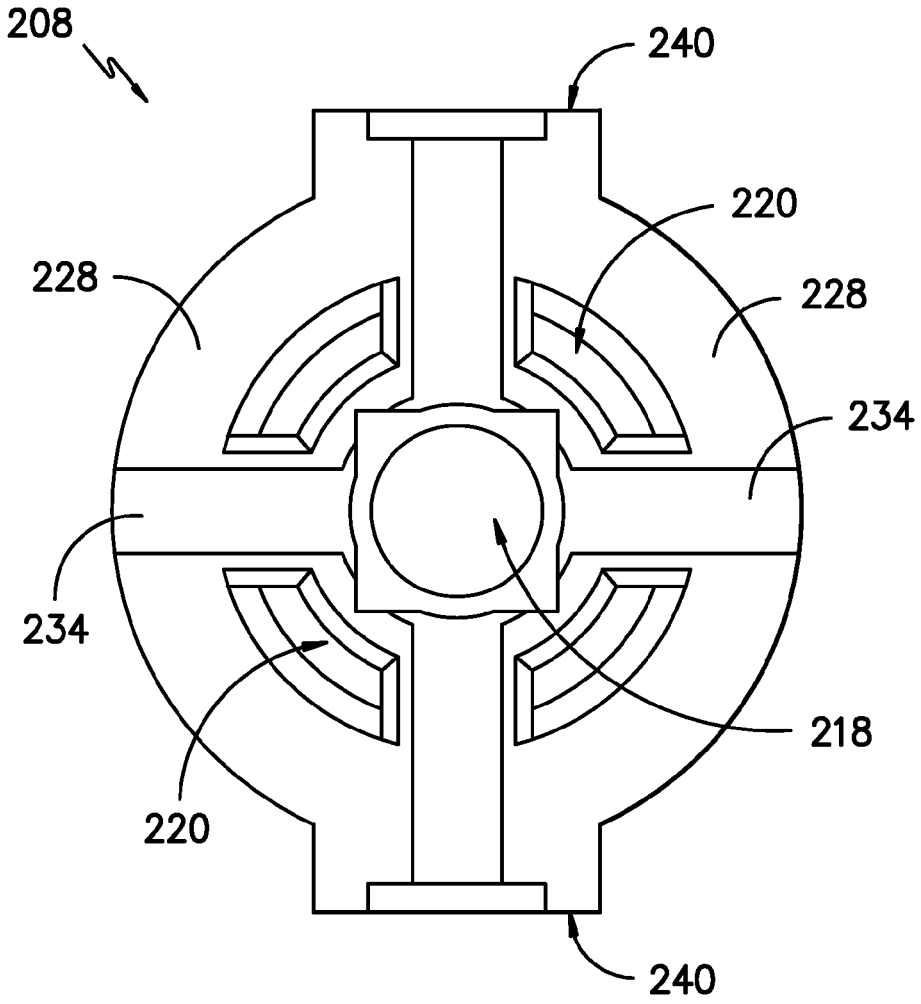
FIG. 6 provides a downstream view of a second component of the exemplary nozzle of FIG. 3.

For structural purposes, nozzle 200 additionally includes a plurality of supports 232 extending from cylindrically-shaped wall 228 into flow channel 220, effectively splitting flow channel 220 into a plurality of flow channel portions proximate to light source 216. More particularly, for this exemplary embodiment, nozzle 200 includes four supports 232 extending from wall 228 to cone 222 and cylindrical channel 218. Such a configuration effectively splits flow channel 220 into four separate flow channel portions proximate to light source 216. Additionally, supports 232 each include a tapered portion 236 extending along axial direction A upstream from supports 232, which can minimize the amount of turbulence created by supports 232 in the liquid flowing through flow channel 220. The structure of this embodiment can also be seen in the downstream view of second component 208 provided in FIG. 6. As shown, four supports 232 extend from wall 228 to support cylindrical channel 218, creating the plurality of flow channel portions proximate to light source 216.

It should therefore be appreciated that as used herein the term "annulus" refers generally to the annular cross-sectional shape of annular liquid flow channel 220 along radial direction R. As such, the term annulus as used herein includes certain exemplary embodiments of nozzle 200 of the present disclosure wherein flow channel 220 may be split into a plurality of flow channel sections by e.g., supports 232 or tapered portions 236, as in the exemplary embodiment of FIGS. 3, 4, and 5.

Referring still to FIGS. 4 and 5, second end 204 can also promote a laminar flow of liquid through nozzle 200. For example, nozzle 200, or more particularly second component 208, further includes a tapered end 234 along the axial direction A towards second end 204. Additionally, for this exemplary embodiment a tip 210 is positioned at second end 204 around a portion of second component 208. Tip 210 includes a plurality of ribs 224 extending along the axial direction A and defining a plurality of liquid passages 226 for the flow of liquid. The passages 226 can reduce the turbulence in the liquid flowing therethrough by directing the liquid along axial direction A. Additionally, tip 210 includes a tapered end 241 along axial direction A towards a downstream end.

Tip 210 can be comprised of any suitable material. By way of example, in one exemplary embodiment, tip 210 can be a translucent material or transparent material, such that when light source 216 directs light in a downstream direction, a portion of tip 210 can be illuminated. Tip 210 of such a configuration can act as e.g., a target for a user attempting to fill a container with a liquid flowing through nozzle 200.

As described, exemplary nozzle 200 can reduce the amount of turbulence in a liquid as it flows from first end 202 to second end 204, and exits from second end 204. More particularly, nozzle 200 can produce a more laminar flow of liquid therethrough and a cylindrical stream of liquid exiting second end 204. Such a configuration can therefore allow light from light source 216 to travel farther down a stream of liquid exiting nozzle 200 than it otherwise may do in a more turbulent flow of liquid. This make the flow more visible for a user of the appliance—thereby improving the ease of use.

Figure 7:
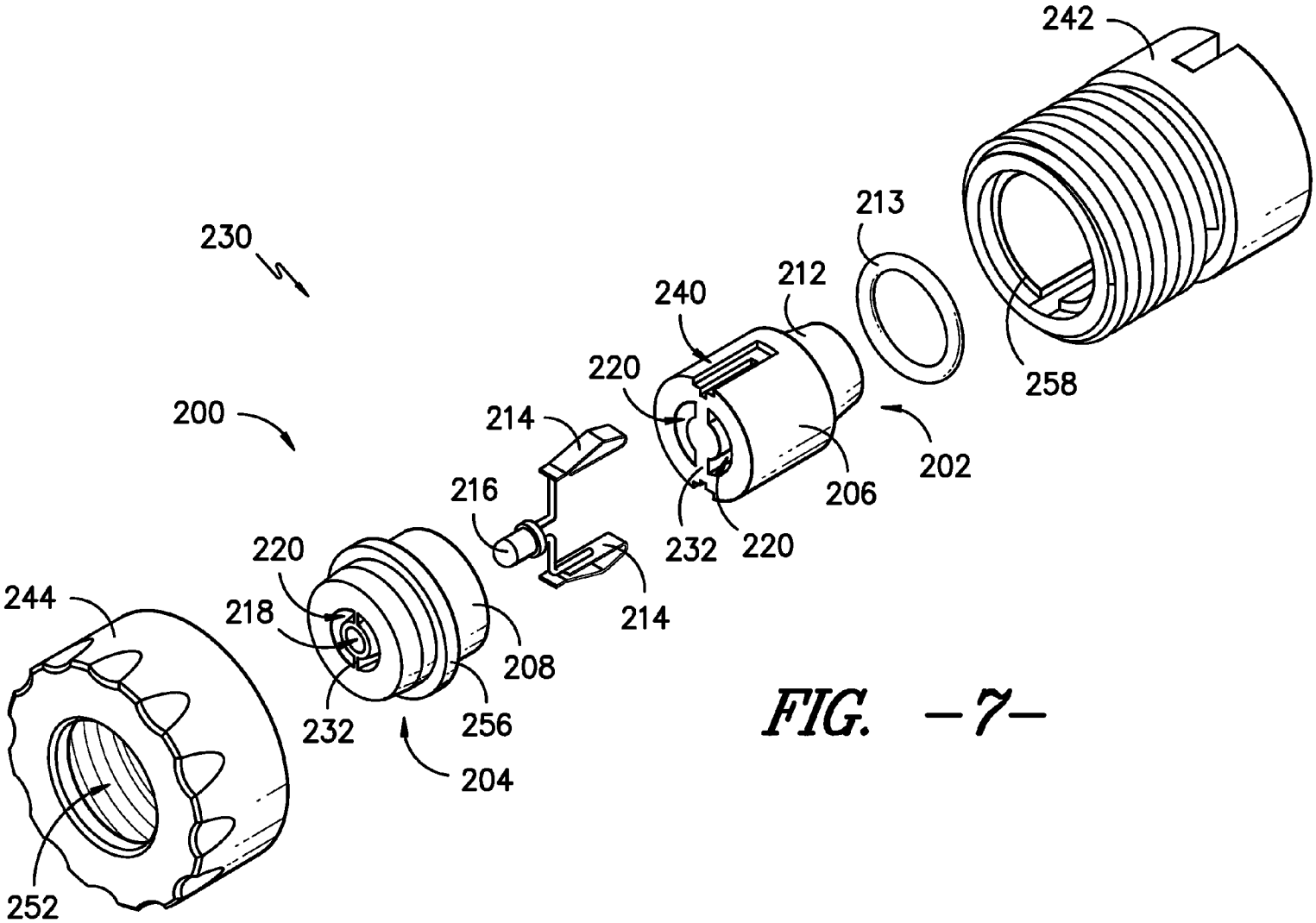
FIG. 7 provides an exploded perspective view of another exemplary embodiment of a dispenser having a nozzle according to the present disclosure.
Figure 8:
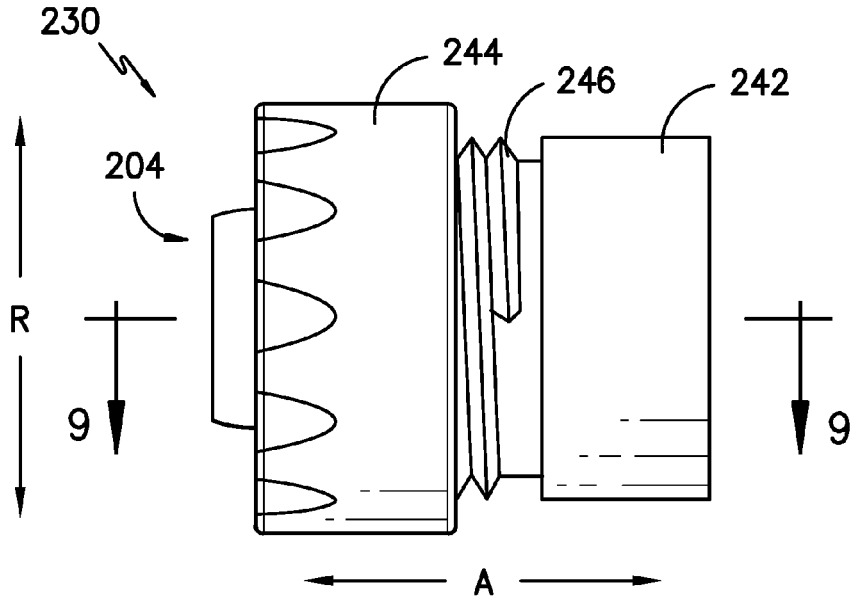
FIG. 8 provides an assembled side view of the exemplary dispenser and nozzle of FIG. 7.
Figure 9:
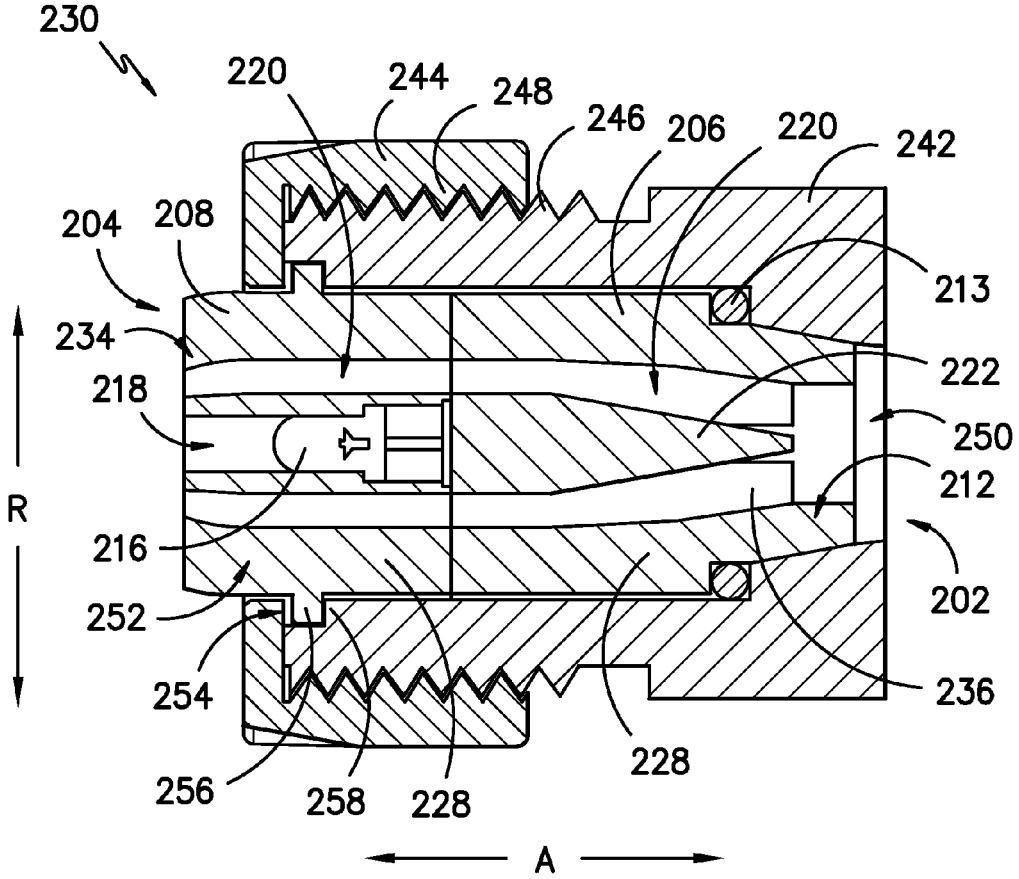
FIG. 9 provides a cross-sectional side view of the exemplary dispenser and nozzle of FIG. 7 from reference line 9-9 in FIG. 8.

Referring now to FIGS. 7, 8, and 9, another exemplary embodiment of a dispenser 230 having a nozzle 200 is provided. FIG. 7 provides an exploded view of an exemplary dispenser 230. FIG. 8 provides an assembled side view of the exemplary dispenser 230 of FIG. 7, and FIG. 9 provides a cross-sectional side view of the exemplary dispenser 230 of FIG. 7 from the reference line 9-9 shown in FIG. 8.

Operation of the exemplary embodiment of dispenser 230 and nozzle 200 provided in FIGS. 7, 8, and 9 is similar to the exemplary embodiment of dispenser 230 and nozzle 200 provided in FIGS. 3, 4, and 5, with a few distinctions, as is discussed below.

Nozzle 200 includes first and second components 206, 208 and extends between first and second ends 202, 204. Additionally, nozzle 200 is configured to promote a substantially laminar flow of liquid therethrough. For example, second end 204 is configured to promote a laminar flow by e.g., having tapered end 234. However, for this exemplary embodiment, nozzle 200 does not additionally include a tip 210. Further, for this exemplary embodiment, first and second components 206, 208 together define cylindrically-shaped wall 228 of nozzle 200, and nozzle 200 is received into a correspondingly shaped dispenser casing 242. It should be appreciated, however, that in other exemplary embodiments of the present disclosure, nozzle 200 and dispenser casing 242 can have any other suitable shape. By way of example, in other exemplary embodiments, nozzle 200 and dispenser casing 242 can each have a squared cross-sectional shape or an ovular cross-sectional shape.

Nozzle 200 additionally includes cone 222 and cylindrical channel 218. Cone 222 is positioned in flow channel 220 upstream of light source 216 and cylindrical channel 218 extends through second component 208. Cone 222 and cylindrically-shaped wall 228 together define an annulus along radial direction R for the flow through of a liquid, as does cylindrical channel 218 and cylindrically-shaped wall 228. For this exemplary embodiment, cone 222 and cylindrical channel 218 are supported by two supports 232 extending from cylindrically-shaped wall 228 to cone 222 and to channel 218. Supports 232 effectively split flow channel 220 into two flow channel portions proximate to light source 216. Additionally, supports 232 each include a tapered portion 236, which can reduce the turbulence in the flow of liquid through nozzle 200.

It should be appreciated, however, that in other exemplary embodiments of the present disclosure, nozzle 200 may include any suitable number of supports 232 to support cone 222 and cylindrical channel 218. For example, in other exemplary embodiments, nozzle 200 may include one support, three supports, etc. As such, in other exemplary embodiments, flow channel 220 may effectively be split into any other suitable number of flow channel portions proximate to light source 216. For example, if three supports are used, flow channel 220 may effectively be split into three flow channel portions proximate to light source 216. It should also be appreciated that in other exemplary embodiments of the present disclosure, one or more of the plurality of flow channel portions proximate to light source 216 may not be configured for the flow of liquid therethrough. For example, one or more of the plurality of flow channel portions proximate to light source 216 can be configured as a heat sink for light source 216.

Nozzle 200 further includes attachment portion 212 positioned at first end 202. For this exemplary embodiment, attachment portion 212 includes an O-ring seal 213 to define a seal between nozzle 200 and liquid supply 250. Additionally, attachment portion 212 tapers radially inward towards first end 202, corresponding to a tapered portion in dispenser casing 242. In such a configuration, nozzle 200 is in fluid communication with liquid supply 250.

Additionally, for this exemplary embodiment dispenser 230 further includes a dispenser cap 244. Dispenser cap 244 is provided to secure nozzle 200 along axial direction A relative to dispenser casing 242. Dispenser cap 244 defines a plurality of circumferential threads 248 that correspond to a plurality of circumferential threads 246 defined by dispenser casing 242. Threads 246 and 248 are configured to engage one another, such that cap 244 can be "screwed-on" to dispenser casing 242, securing nozzle 200 along the axial direction A (FIGS. 8 and 9). Dispenser cap 244 further defines an annular opening 252 and an annular edge 254. Annular opening 252 corresponds approximately in size to second end 204 of nozzle 200, such that second end 204 extends through opening 252 when assembled. Further, annular edge 254 is configured to contact an annular lip 256 extending radially outward from nozzle 200. Nozzle 200 is therefore secured along the axial direction A by having annular lip 256 contacted by annular edge 254 defined by dispenser cap 244 and an annular ledge 258 defined by dispenser casing 242. Nozzle 200 of such a configuration can be removed by unscrewing cap 244 from casing 242 (FIG. 7).

It should be appreciated, however, that in other exemplary embodiments, nozzle 200 may be releasably connected to liquid supply 250 and dispenser casing 242 by any other suitable means. By way of example, attachment portion 212 may be a John Guest fitting, nozzle 200 may be snap-fit into dispenser casing 242, or nozzle 200 itself may be screwed-in to dispenser casing 242. Other means for releasably connecting nozzle 200 to liquid supply 250 may be provided as well.

In any of the above exemplary embodiments it may be beneficial to allow electrical contacts 214 to be variably positioned along a circumferential direction relative to dispenser casing 242. As such, it should be appreciated that in other exemplary embodiments, electrical contacts 214 may have any other suitable configuration. For example, in another exemplary embodiment, electrical contacts 214 can have a circumferential configuration, similar to e.g., a headphones jack.

In further exemplary embodiments of the present disclosure, dispenser 230 having nozzle 200 may have any other suitable configuration. For example, dispenser 230 may be configured such that nozzle 200 is not releasably connected to dispenser casing 242 and liquid supply 250. In such a configuration, nozzle 200 may be attached to dispenser casing 242 and liquid supply 250 by any suitable means, such as gluing, welding, etc.

This written description uses examples to disclose the invention, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dispenser for dispensing a liquid, comprising:
a liquid supply;
a nozzle in fluid communication with the liquid supply and defining an axial direction and a radial direction that are orthogonal to each other, the nozzle comprising
a first end along the axial direction;
a second end downstream and opposite to the first end along the axial direction;
a light source having at least a portion positioned between the first end and the second end;
an annular liquid flow channel extending longitudinally along the axial direction between the first end to the second end and around the light source, the flow channel configured to promote a substantially laminar flow of liquid;
a cone positioned upstream of the light source and in the flow channel, the cone having a tip directed towards the first end; and
a plurality of contacts positioned along an outer surface of the nozzle and in electrical communication with the light source, the contacts configured to provide the light source with electrical power.

2. A dispenser as in claim 1, wherein the light source is positioned approximately in the center of the nozzle along the radial direction.

3. A dispenser as in claim 1, wherein the cone has a longitudinal axis that is substantially parallel to the axial direction.

4. A dispenser as in claim 1, wherein the nozzle further comprises a cylindrical channel extending along the axial direction, and wherein at least a portion of the light source is positioned in the cylindrical channel.

5. A dispenser as in claim 1, wherein the nozzle further comprises a first component and a separate second component.

6. A dispenser as in claim 1, wherein the flow channel defines a straight section, and wherein the straight section defines a length of at least about 0.01 meters, such that a liquid traveling therethrough has a Reynolds number in the range of about 2500 to about 700.

7. A dispenser as in claim 1, wherein the nozzle further comprises a tip positioned at the second end of the nozzle, and wherein at least a portion of the tip is comprised of a transparent material or translucent material.

8. A dispenser as in claim 1, wherein the nozzle further comprises a tip positioned at the second end of the nozzle, and wherein the tip comprises a plurality of ribs extending along the axial direction and configured to promote a laminar flow of liquid.

9. A dispenser as in claim 1, wherein the nozzle further comprises an attachment portion positioned at the first end, the attachment portion defining a seal for connection with the liquid supply.

10. A dispenser as in claim 1, wherein the nozzle is releasably connected to the liquid supply.

11. A dispenser as in claim 1, wherein the light source comprises a light emitting diode.

12. A dispenser as in claim 1, wherein the flow channel splits into a plurality of flow channel portions proximate to the light source.

13. A dispensing assembly for use in a refrigerator appliance, the dispensing assembly comprising:

a dispenser recess; and a dispenser comprising a liquid supply positioned proximate to the dispenser recess;

a nozzle in fluid communication with the liquid supply and configured to promote a substantially laminar flow of a liquid from the liquid supply to the dispenser recess, the nozzle comprising a first end configured to receive a liquid from the liquid supply;

a second end configured to dispense the liquid;

a circumferential wall extending from the first end to the second end;

a light source having at least a portion positioned within the circumferential wall; and a cone positioned upstream of the light source within the circumferential wall, the cone and the circumferential wall together defining an annulus for the flow through of the liquid from the first end towards the second end; and plurality of contacts positioned along an outer surface of the nozzle and in electrical communication with the light source, the contacts configured to provide the light source with electrical power.

14. A dispensing assembly as in claim 13, wherein the nozzle defines an axial direction, and wherein the cone has a longitudinal axis that is substantially parallel to the axial direction.

15. A dispensing assembly as in claim 13, wherein the flow channel defines a straight section, and wherein the straight section defines a length of at least about 0.01 meters, such that a liquid traveling therethrough has a Reynolds number in the range of about 2500 to about 700.

16. A dispensing assembly as in claim 13, wherein the nozzle defines an axial direction and further comprises a tip positioned at the second end, and wherein the tip comprises a plurality of ribs extending along the axial direction and configured to promote a laminar flow of liquid.

17. A dispensing assembly as in claim 13, wherein the nozzle further comprises an attachment portion positioned at the first end, the attachment portion defining a seal for connection with the liquid supply.

18. A dispensing assembly as in claim 13, wherein the nozzle is releasably connected to the liquid supply.

* * * * *